US006240645B1

(12) United States Patent
Ozeki

(10) Patent No.: US 6,240,645 B1
(45) Date of Patent: Jun. 5, 2001

(54) SEWING CUTTER

(75) Inventor: Katuhiko Ozeki, Osaka (JP)

(73) Assignee: Clover Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/079,001

(22) Filed: May 14, 1998

(30) Foreign Application Priority Data

Nov. 7, 1997 (JP) ..... 9-009818

(51) Int. Cl.[7] ..... B26B 29/00
(52) U.S. Cl. ..... 30/294; 30/240
(58) Field of Search ..... 30/240, 294

(56) References Cited

U.S. PATENT DOCUMENTS 1,265,151 * 5/1918 Wilczek ..... 30/240
1,796,463 * 3/1931 Kaltenbach et al. ..... 30/240
1,876,075 * 9/1932 Reichert, Sr. et al. ..... 30/240
1,986,016 * 1/1935 Royston ..... 30/294
2,199,380 * 5/1940 Walraven ..... 30/294
2,601,414 * 6/1952 Mittelstaedt ..... 30/294
2,610,399 * 9/1952 Adams et al. ..... 30/294
2,693,641 * 11/1954 Omoto ..... 30/294
2,701,911 * 2/1955 Maescher ..... 30/240
2,705,833 * 4/1955 Grantz ..... 30/294
2,710,448 * 6/1955 Andrews ..... 30/294
2,764,814 * 10/1956 Jecker ..... 30/294
3,028,670 * 4/1962 Tilly ..... 30/294
3,100,935 * 8/1963 Leafe ..... 30/294
3,562,907 * 2/1971 Greenberg ..... 30/240
3,972,117 * 8/1976 Fogg ..... 30/294
3,975,822 * 8/1976 Mabus ..... 30/294

* cited by examiner

*Primary Examiner*—M. Rachuba
(74) *Attorney, Agent, or Firm*—Merchant & Gould P.C.

(57) ABSTRACT

A sewing cutter is provided which includes a handle, a cutting member attached to the handle, and a guiding member supported by the handle. The guiding member, which is arranged below the cutting member, may be an elongated plate whose front end is tapered. The guiding member is provided with an upper surface which is brought into facing relation to cloth to be cut by the cutting member.

10 Claims, 16 Drawing Sheets

SEWING CUTTER

BACKGROUND OF THE INVENTION

1. Field of the Invention

The present invention relates to a sewing cutter used for making an ornamental quilt such as "a straight slash quilt."

2. Description of the Related Art

The above-mentioned straight slash quilt is produced as follows. First, a quilt 7 shown in FIGS. 16A–16B is prepared. air. The quilt 7 includes a plurality of rectangular cloth layers 7*a*–7*d* which are sewn together by thread 70. The lowermost cloth layer 7*a* is larger than the upper cloth layers 7*b*–7*d* which are equal in size. As shown in FIG. 16A, the seams 71 running bias extend in parallel to each other and are evenly spaced.

Then, as shown in FIG. 17, a plurality of straight cuts (or slashes) are made in the upper layers 7*b*–7*d* between the adjacent seams 71 for dividing the upper layers 7*b*–7*d* into plural groups of strip-shaped layers 72. Thus, an intermediate quilt 7' is obtained. The intermediate quilt 7' is washed in water for shrinking the strip-shaped layers 72, and dried. As a result, the layers 72 are made fluffy, as shown in FIG. 18. Thus, a straight slash quilt 7" is obtained.

Conventionally, the above-mentioned cutting operation for the upper cloth layers 7*b*–7*d* is performed by using sewing scissors (not shown) or a ripper 9 as shown in FIG. 19, for example.

As shown in FIG. 20, the ripper 9 includes a handle 90 to be held by the user, and an elongated metal member 91 attached to the handle 90. The elongated member 91 is provided with a protrusion 91*a*, and a recess 91*b* which is formed with a cutting edge 92. With such an arrangement, the conventional ripper 9 is used for ripping thread to open seams by utilizing the protrusion 91*a* or for cutting cloth to make a button hole for example by utilizing the cutting edge 92.

It has been found that, when used for cutting the upper cloth layers 7*b*–7*d,* the conventional ripper 9 suffers some problems which will be described below.

Specifically, to cut the upper cloth layers 7*b*–7*d* with the conventional ripper 9, the user inserts the protrusion 91*a* between the lowermost layer 7*a* and the upper layers 7*b*–7*d* as shown in FIG. 21. Then, the user moves the ripper 9 forward as indicated by an arrow in the figure. As a result, the cutting edge 92 cuts through the upper layers 7*b*–7*d* between the adjacent seams 71, as shown in FIG. 19.

As can be seen, for performing the cutting operation smoothly, it is necessary for the user to use his free hand for stretching the upper cloth layers 7*b*–7*d* transversely of the cutting direction. However, since the distance between the adjacent seams 71 is rendered rather small (about 7 mm for example), it is difficult for the user (especially for the beginner) to properly stretch the upper layers 7*b*–7*d,* while simultaneously moving the ripper 9 forward by the other hand.

Further, as shown in FIG. 22, the elongated member 91 of the ripper 9 has a relatively small thickness Si as compared with the distance S2 between the adjacent seams 71. Thus, as being moved forward, the cutting edge of the ripper 9 may unduly meander, as shown in FIG. 22.

Still further, the protrusion 91*a* of the conventional ripper 9 is brought into direct contact with the lowermost layer 7*a,* as shown in FIG. 21. Thus, as the ripper 9 is moved forward, the lowermost layer 7*a* will be damaged by the protrusion 91*a*.

The user may encounter the same problems in using sewing scissors for cutting the upper cloth layers 7*b*–7*d*.

SUMMARY OF THE INVENTION

It is, therefore, an object of the present invention to provide a sewing cutter capable of overcoming the problems described above.

According to the present invention, there is provided a sewing cutter including a handle, a cutting member attached to the handle, and a guiding member supported by the handle. The guiding member has a surface brought into facing relation to cloth to be cut by the cutting member.

Preferably, the guiding member includes a plate which is elongated in a cutting direction and whose width is greater than that of the cutting member.

The cutting member may have a cutting point for the cloth to be cut, while the guiding member may be provided with a front portion arranged ahead of the cutting point in a cutting direction.

Preferably, the front portion of the guiding member is tapered.

According to a preferred embodiment, the cutting member and the guiding member are detachable from the handle.

The handle may be integrally formed with the guiding member.

The cutting member may be integrally formed with the guiding member.

According to a preferred embodiment, the cutting member includes an elongated plate which is formed with a protrusion and a cutting edge adjacent to the protrusion.

According to another embodiment, the cutting member is a circular plate which is supported for rotation and formed with a cutting edge extending circumferentially of the circular plate. In this case, the cutting of the cloth to be cut is performed when the cloth is introduced between the cutting member and the surface brought into facing relation to the cloth.

According to another embodiment, the sewing cutter further includes an attachment which is separate from the handle and integrally formed with the guiding member. In this embodiment, the guiding member is formed with a retreated portion for avoiding contact with the cutting member.

According to another embodiment, the cutting member includes an elongated plate having a longitudinal side which is entirely formed with a cutting edge. In this embodiment again, the cutting of the cloth is performed when the cloth is introduced between the cutting member and the above-mentioned surface of the guiding member. Preferably, the cutting member includes a front end portion and a rear end portion, wherein the front end portion is positioned farther from the guiding member than the rear end portion. Similarly to the previous embodiment, the guiding member is formed with a retreated portion for avoiding contact with the cutting member.

Other objects, features and advantages of the present invention will be apparent from the detailed description of the embodiment given below with reference to the accompanying drawings.

DETAILED DESCRIPTION OF THE PREFERRED EMBODIMENT

The preferred embodiments of the present invention will be described below with reference to the accompanying drawings.

Figure 1:
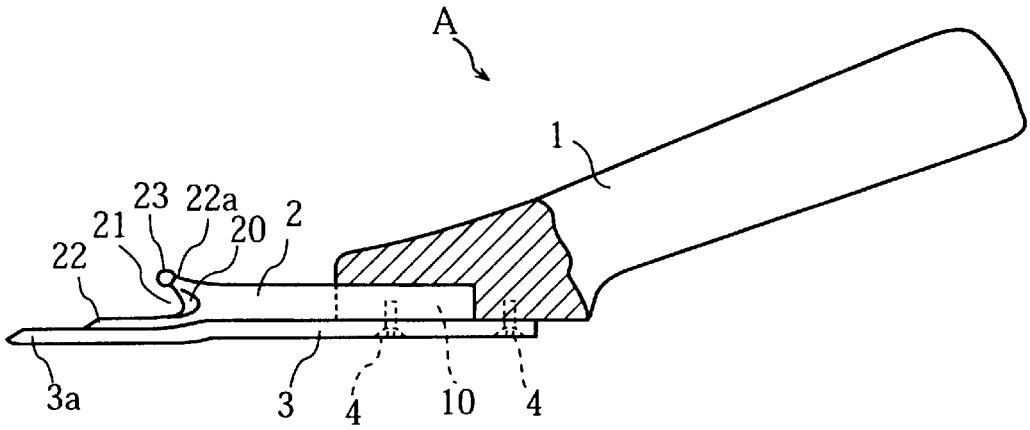
FIG. 1 is a side view, partly in section, showing a sewing cutter according to a first embodiment of the present invention.
Figure 2:
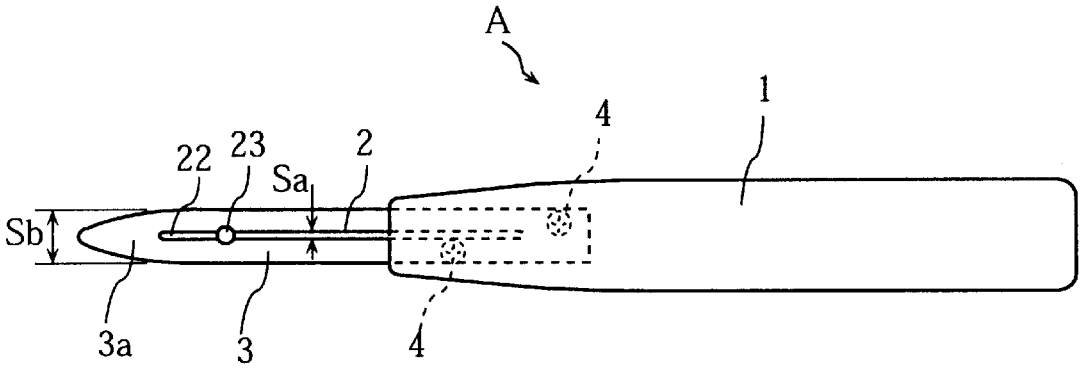
FIG. 2 is a plan view showing the same cutter.

FIGS. 1 and 2 show a sewing cutter A according to a first embodiment of the present invention. The sewing cutter A includes a handle 1, an elongated cutting member 2 and a guiding member 3. The handle 1, which may be made of wood, synthetic resin, metal or the like, is formed into a suitable bar-like shape so that the user can hold it easily with one hand. As shown in FIG. 1, the handle 1 extends obliquely with respect to the cutting member 2 and the guiding member 3.

Figure 20:
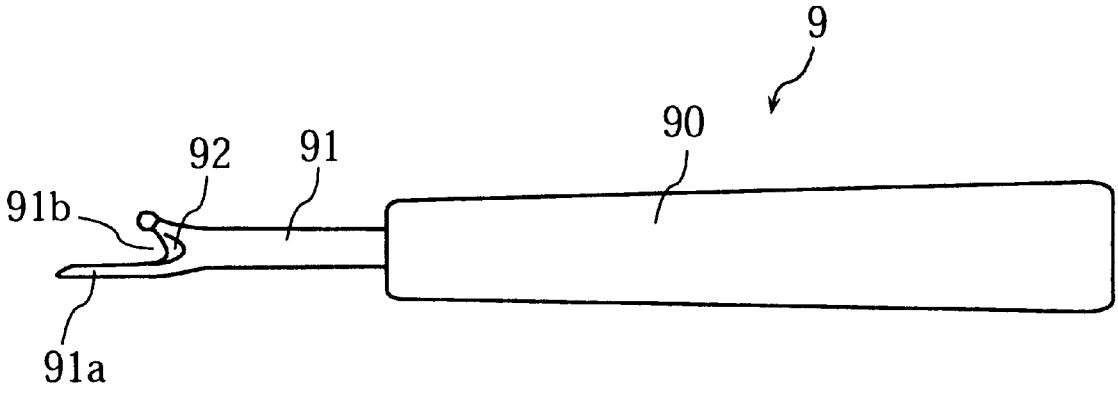
FIG. 20 is a side view showing the conventional ripper.
Figure 21:
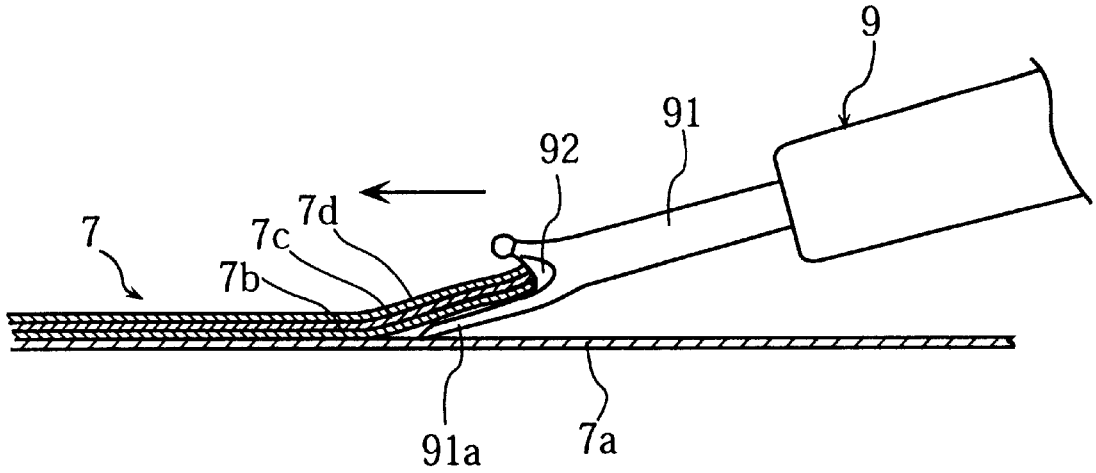
FIG. 21 is a side view illustrating the conventional ripper in use.
Figure 22:
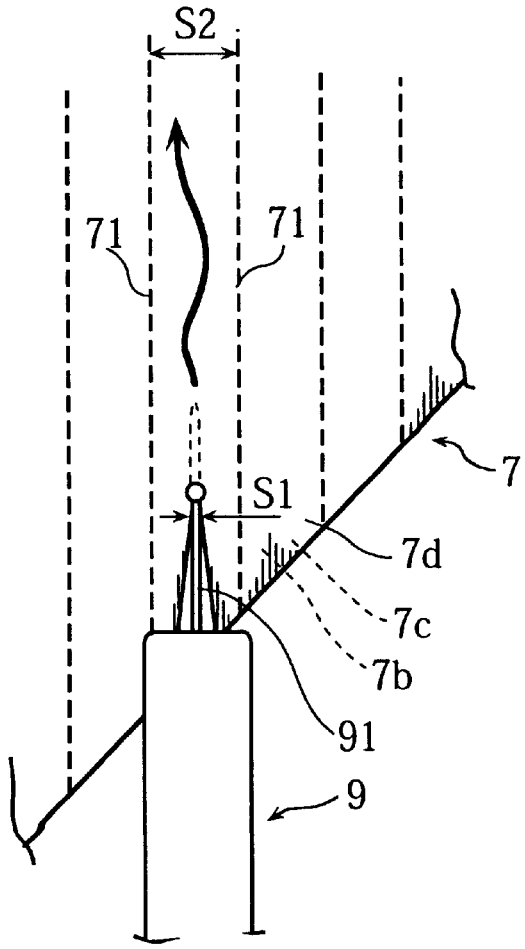
FIG. 22 is a plan view illustrating the conventional ripper in use.

The cutting member 2 of the cutter A has the same arrangement as the elongated member 91 of the conventional ripper 9 described with reference to FIG. 20. Namely, the cutting member 2 has a metal body which is elongated and small in width. The cutting member 2 is formed with a longer protrusion 22, a shorter protrusion 22*a* and an arcuately retreated portion 21 arranged between the two protrusions. The longer protrusion 22 has a pointed end, whereas the shorter protrusion 22*a* has a round end 23 for protecting the user from injury. The retreated portion 21 is formed with a cutting edge 20. The handle 1 is formed with a suitable groove or slit 10 having a downward opening. In this arrangement, it is possible to releasably fix the base end of the cutting member 2 in the slit 10.

The guiding member 3 may be pressworked from a metal material to be formed into an elongated thin plate. The guiding member 3 is rendered longer than the cutting member 2. The guiding member 3 has a base portion which is releasably attached to the handle 1 by screws 4. On the opposite side to the base portion, the guiding member 3 has a front portion 3*a* which tapers to a round tip. Except the front portion 3*a,* the guiding member 3 has a constant width Sb which is greater than the width Sa of the cutting member 2.

When assembled, the guiding member 3 is arranged under the cutting member 2. The front portion 3*a* of the guiding member 3 extends forward beyond the cutting edge 20 and the tip of the longer protrusion 22.

Figure 3:
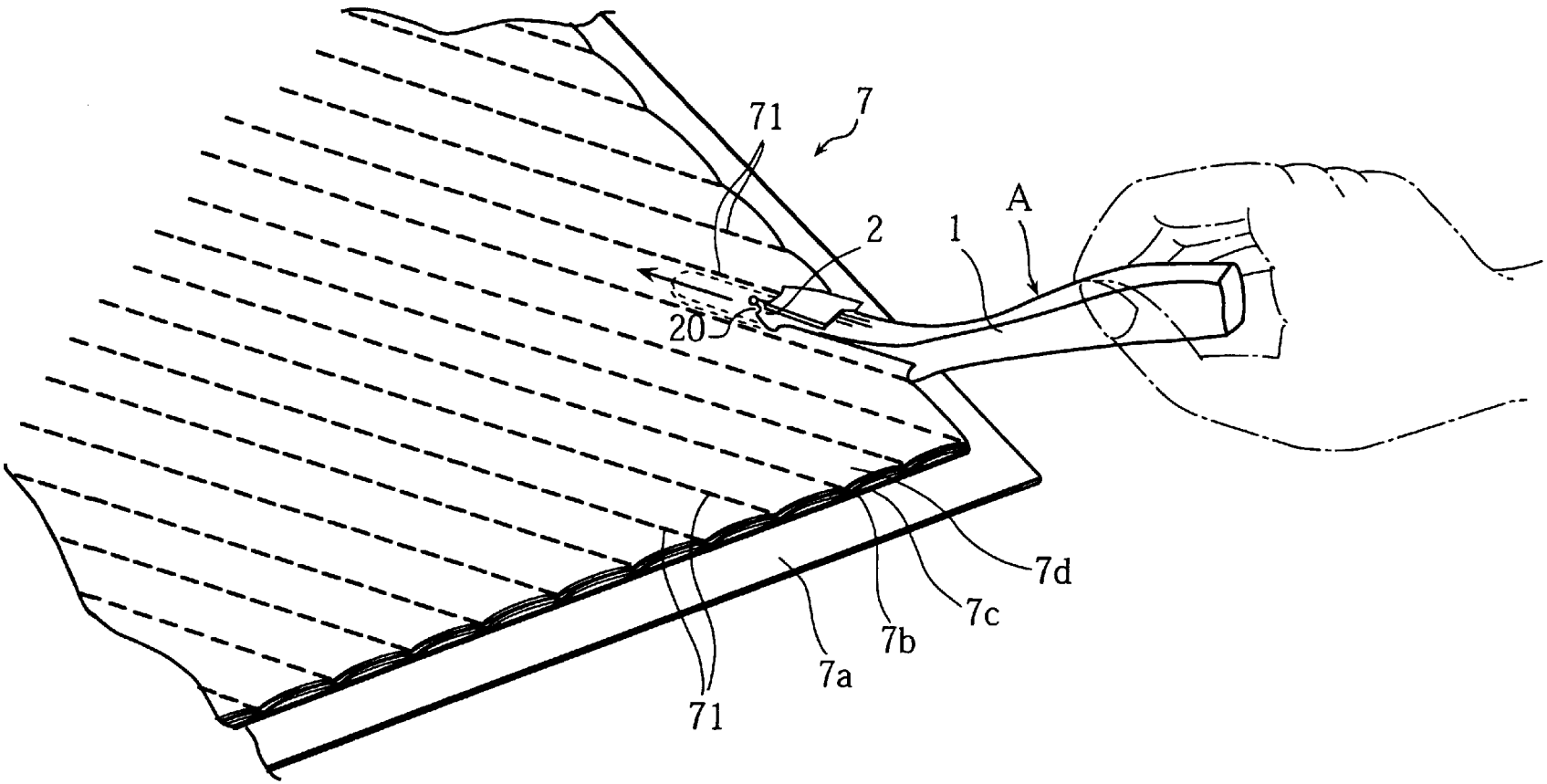
FIG. 3 is a perspective view illustrating how to use the same cutter.
Figure 4:
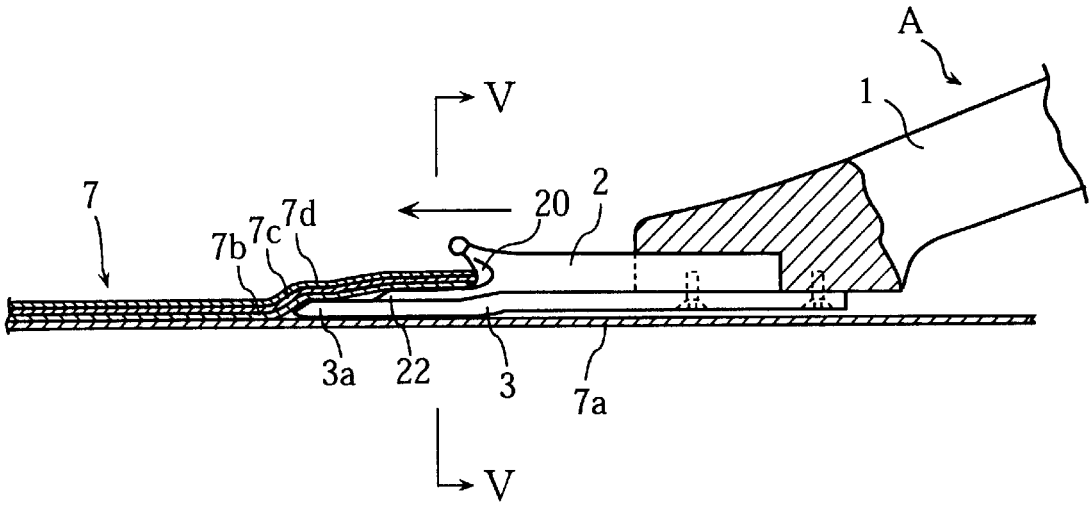
FIG. 4 is a side view showing the same cutter in use.
Figure 5:
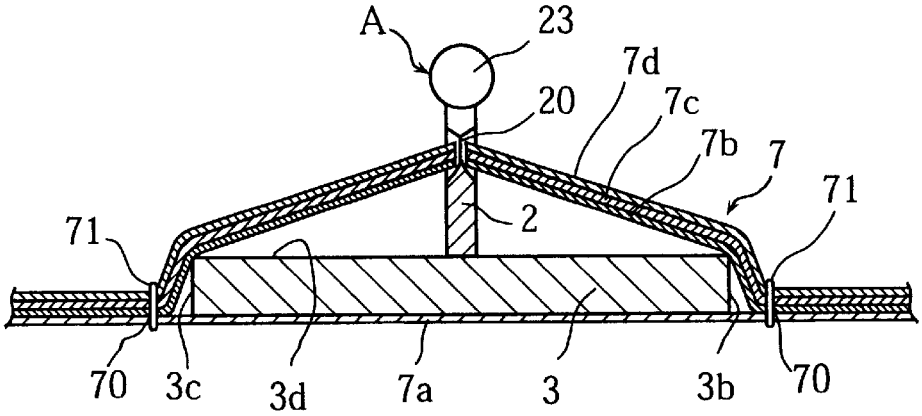
FIG. 5 is a sectional view taken along lines V—V in FIG. 4.
Figure 16A:
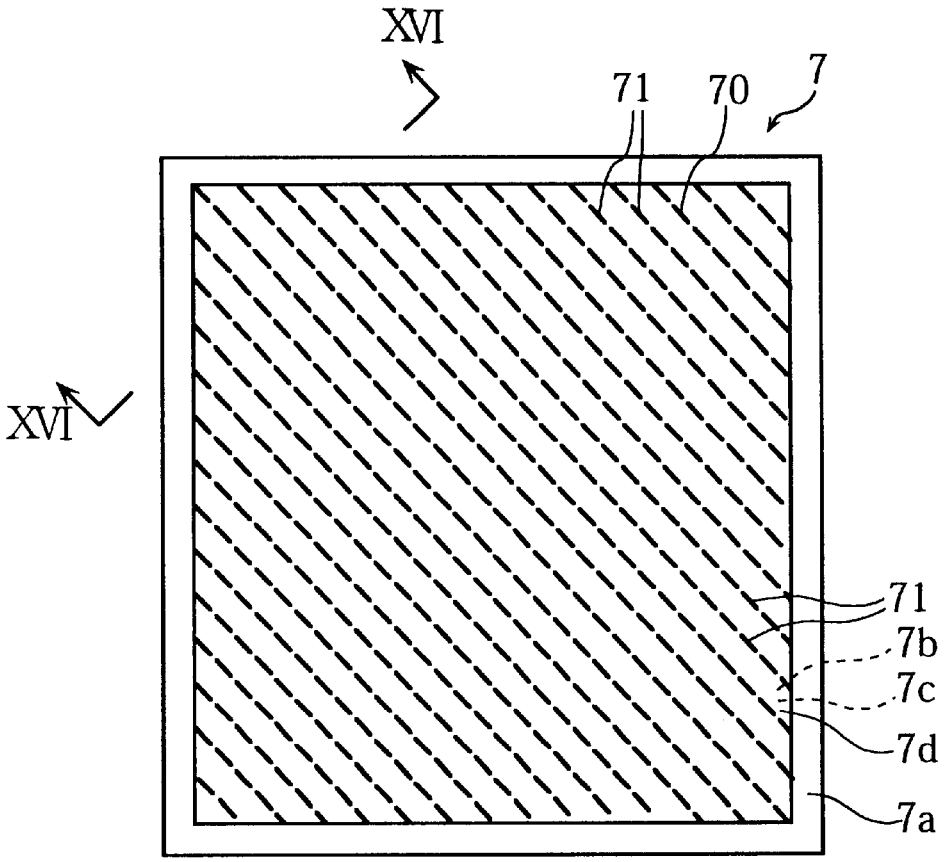
FIG. 16A is a plan view showing a material quilt used for making a straight slash quilt.
Figure 16B:
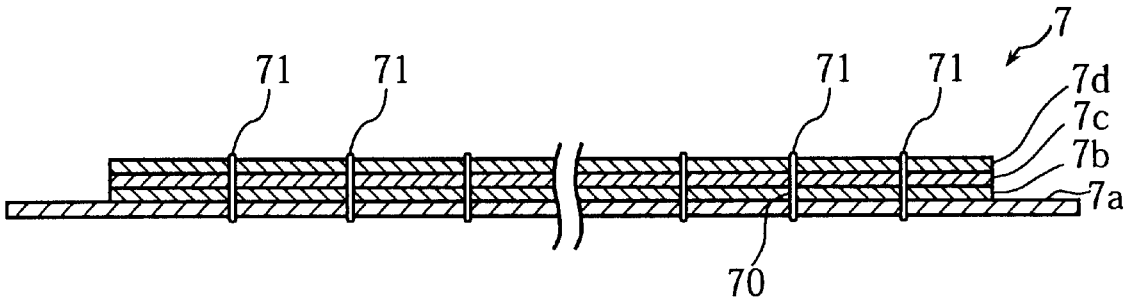
FIG. 16B is a sectional view taken along lines XVI—XVI in FIG. 16A.
Figure 17:
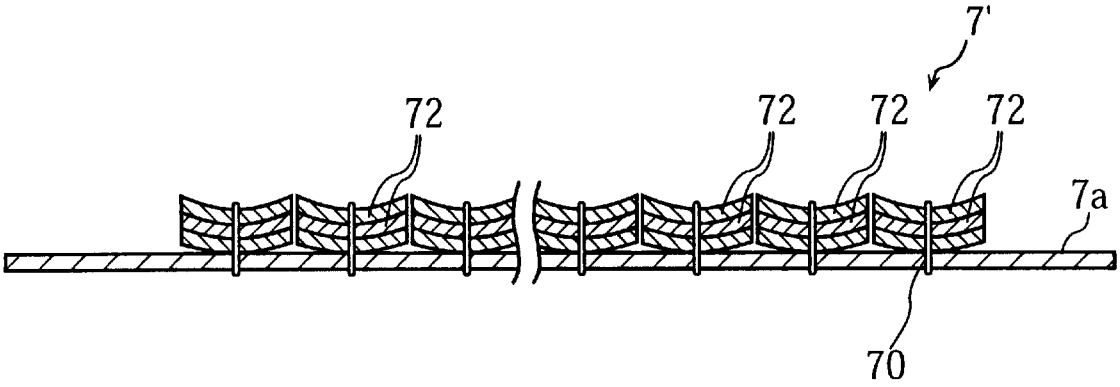
FIG. 17 is a sectional side view showing an intermediate quilt provided with predetermined slashes.
Figure 18:
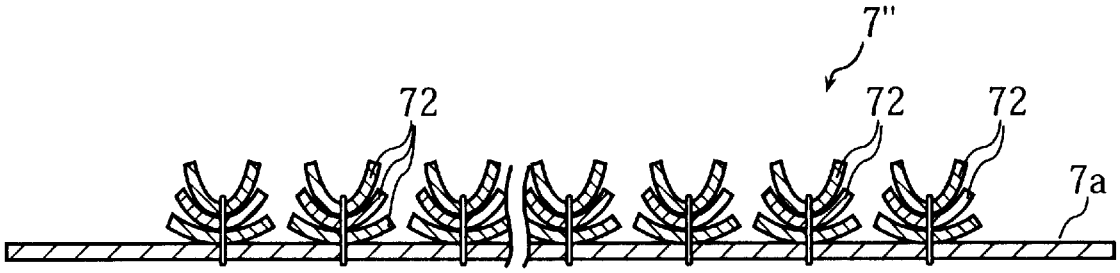
FIG. 18 is a sectional side view showing a product slash quilt.
Figure 19:
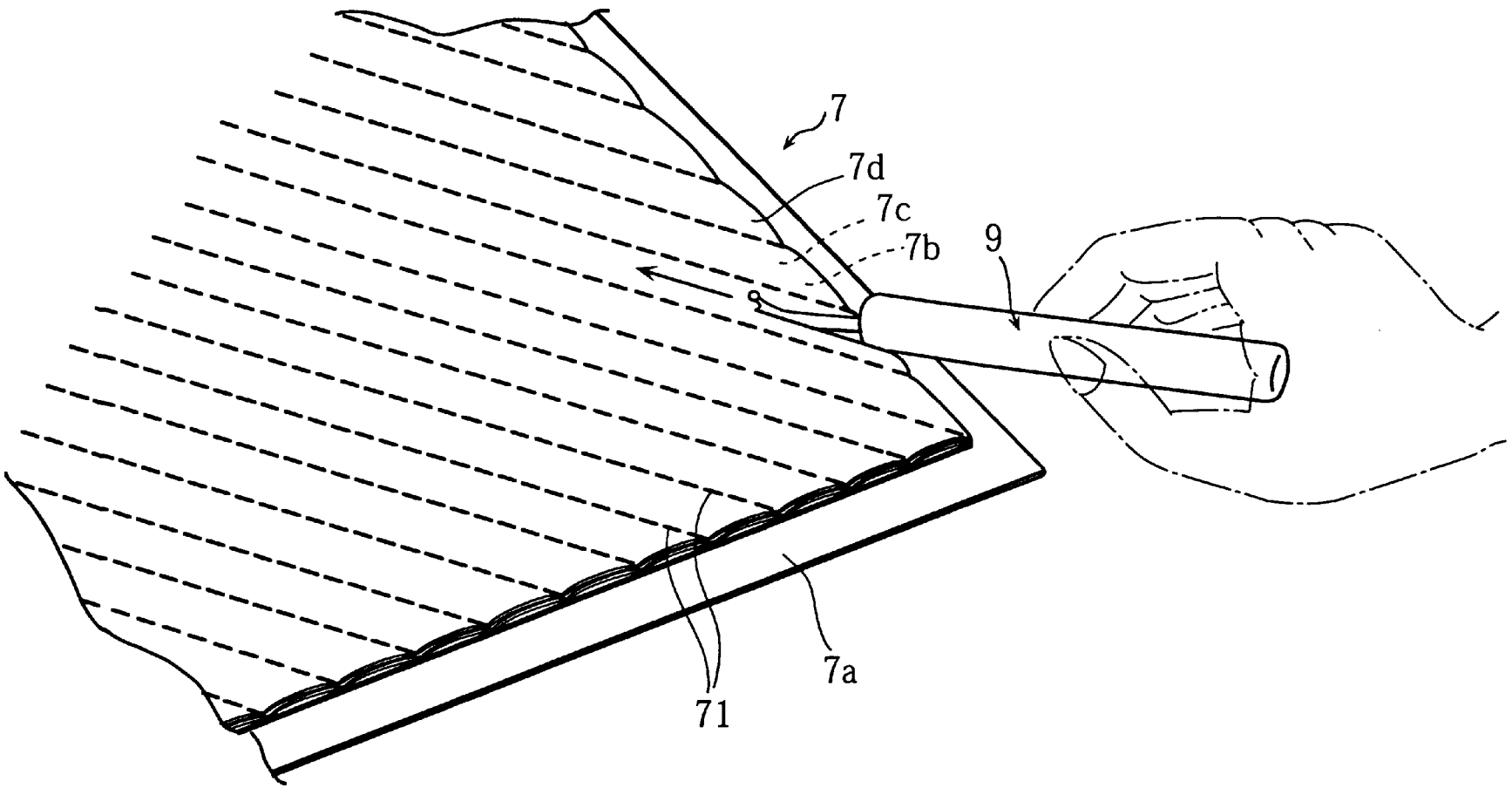
FIG. 19 illustrates the cutting operation for the material quilt using a conventional ripper.

Referring to FIGS. 3–5, description will now be made to how to use the sewing cutter A. Here, it should be appreciated that the quilt 7 shown in FIG. 3 has the same arrangement as that shown in FIGS. 16A and 16B. Namely, the quilt 7 of FIG. 3 includes a lowermost cloth layer 7*a* and upper cloth layers 7*b*–7*d* arranged on the lowermost cloth layer. Those cloth layers 7*a*–7*d* are held together by thread at seams 71 which extend in parallel to each other at constant intervals. Between the lowermost cloth layer 7*a* and the upper cloth layers 7*b*–7*d,* there are elongated spaces defined by adjacent seams 71.

To cut the upper cloth layers 7*b*–7*d* by using the sewing cutter A, first the guiding member 3 is inserted into one of the above-mentioned elongated spaces, as shown in FIGS. 3 and 4. For facilitating the insertion, the width Sb of the guiding member 3 is set to be generally equal to or slightly smaller than the width (about 7 mm for example) of the elongated space. When inserted, the upper surface 3*d* of the guiding member 3 is brought into facing relation to the upper cloth layers 7*b*–7*d.*

After insertion of the guiding member 3, the upper cloth layers 7*b*–7*d* are stretched widthwise between the adjacent seams 71 due to the presence of the guiding member 3, as shown in FIG. 5. In this arrangement, the upper cloth layers 7*b*–7*d* are easily cut by the cutting edge 20 of the cutting member 2.

As the guiding member 3 is moved forward along the elongated space, the longitudinal edges 3*b*–3*c* of the guiding member 3 are properly guided by the adjacent seams 71, whereby the guiding member is moved in a straight line. In other words, according to the present invention, it is possible to prevent the cutting member 2 from unduly meandering. Here, it should be appreciated that the front portion 3*a* of the guiding member 3 extends forward beyond the cutting edge 20. With such an arrangement, it is possible to prevent the front portion 3*a* of the guiding member 3 from coming out of the elongated space in performing the cutting operation (see FIG. 3).

Further, the guiding member 3 of the sewing cutter A is easily detached from the handle 1 by undoing the screws 4. Thus, after removal of the guiding member 3, the cutter A is used to cut threads for opening seams for example, by utilizing the protrusion 22. Still further, since the cutting member 2 is releasable from the handle 1, the cutting member 2 is easily replaced with a new one when the former becomes blunt or damaged.

Figure 6:
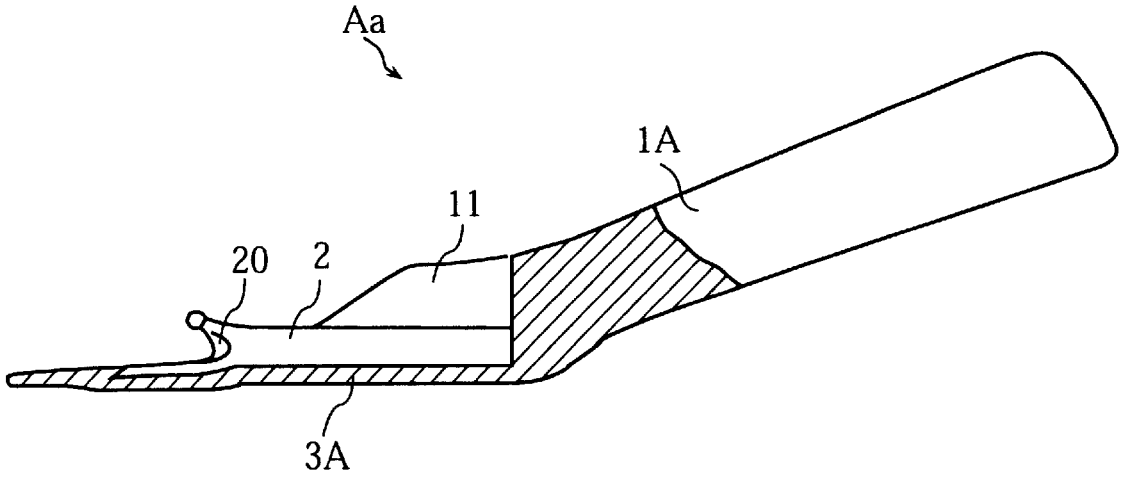
FIG. 6 is a side view, partly in section, showing a sewing cutter according to a second embodiment of the present invention.

FIG. 6 shows a sewing cutter Aa according to a second embodiment of the present invention. In this embodiment and the other embodiments described hereinafter, the same members or elements similar to those of the first embodiment are shown by the same references. The illustrated sewing cutter Aa includes a handle 1A which is integrally formed with a guiding member 3A. The cutting member 2 of this embodiment is fixedly inserted into a slit 11 formed in the handle 1A. As shown in FIG. 6, the slit 11 has an upward opening. Since the handle 1A and the guiding member 3A are integrally formed, the manufacturing procedure for the sewing cutter Aa is simplified. Thus, the production cost is advantageously reduced.

Figure 7A:
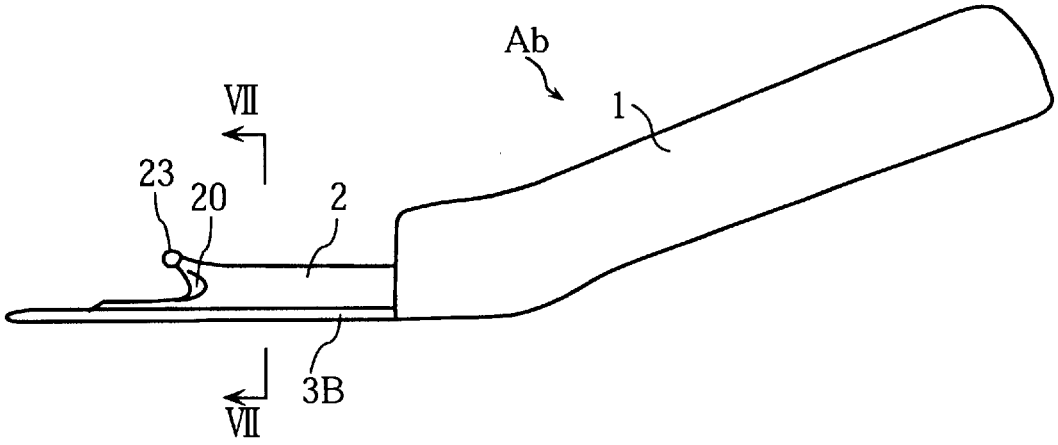
FIG. 7A is a side view showing a sewing cutter according to a third embodiment of the present invention.
Figure 7B:
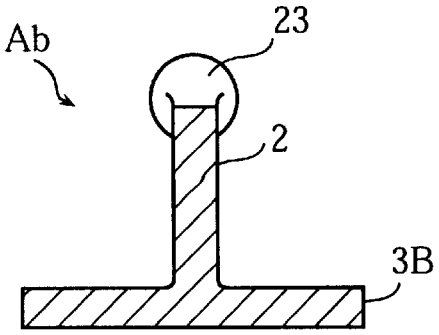
FIG. 7B is a sectional view taken along lines VII—VII in FIG. 7A.

FIGS. 7A and 7B show a sewing cutter Ab according to a third embodiment of the present invention. The illustrated cutter Ab includes a cutting member 2 which is integrally formed with a guiding member 3B (see FIG. 7B). The cutting member 2 together with the guiding member 3B is releasably fixed to the handle 1 by a suitably configured slit (not shown) formed in the handle 1.

It should be appreciated that, according to the present invention, it is possible to arrange that a handle, a cutting member and a guiding member are separately produced (first embodiment), or that a handle and a guiding member are integrally formed (second embodiment), or that a cutting member and a guiding member are integrally formed (third embodiment). It is also possible to produce a cutting member and a guiding member separately and attach them later by using an adhesive.

FIGS. 8–14 show a sewing cutter Ac according to a fourth embodiment of the present invention. The sewing cutter Ac includes a handle 1C, a cutting member 2C and an attachment 5.

The handle 1C, which may be made of a synthetic resin for example, has a generally straight body. The attachment 5, which may also be made of a synthetic resin, is produced separately from the handle 1C. The attachment 5 is integrally formed with a guiding member 3*c* extending at a predetermined angle with respect to the attachment 5. The cutting member 2C of the sewing cutter Ac is of a circular form provided with a cutting edge 20*c* extending along the entire circumference of the circular member.

Figure 9:
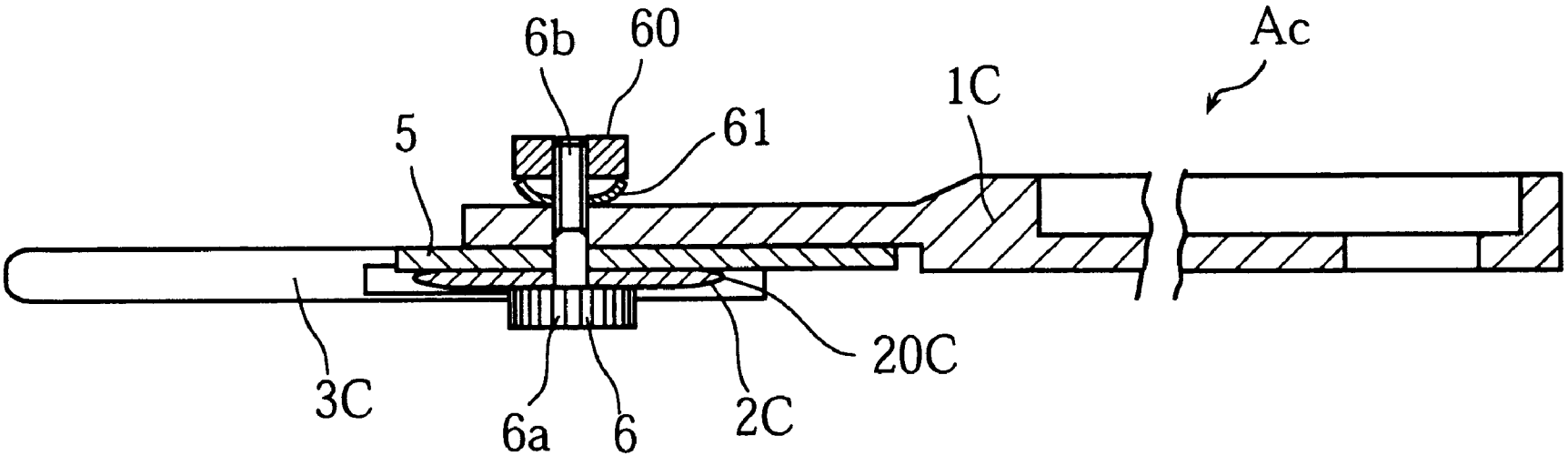
FIG. 9 is a sectional view showing a principal portion of the cutter in FIG. 8.
Figure 10:
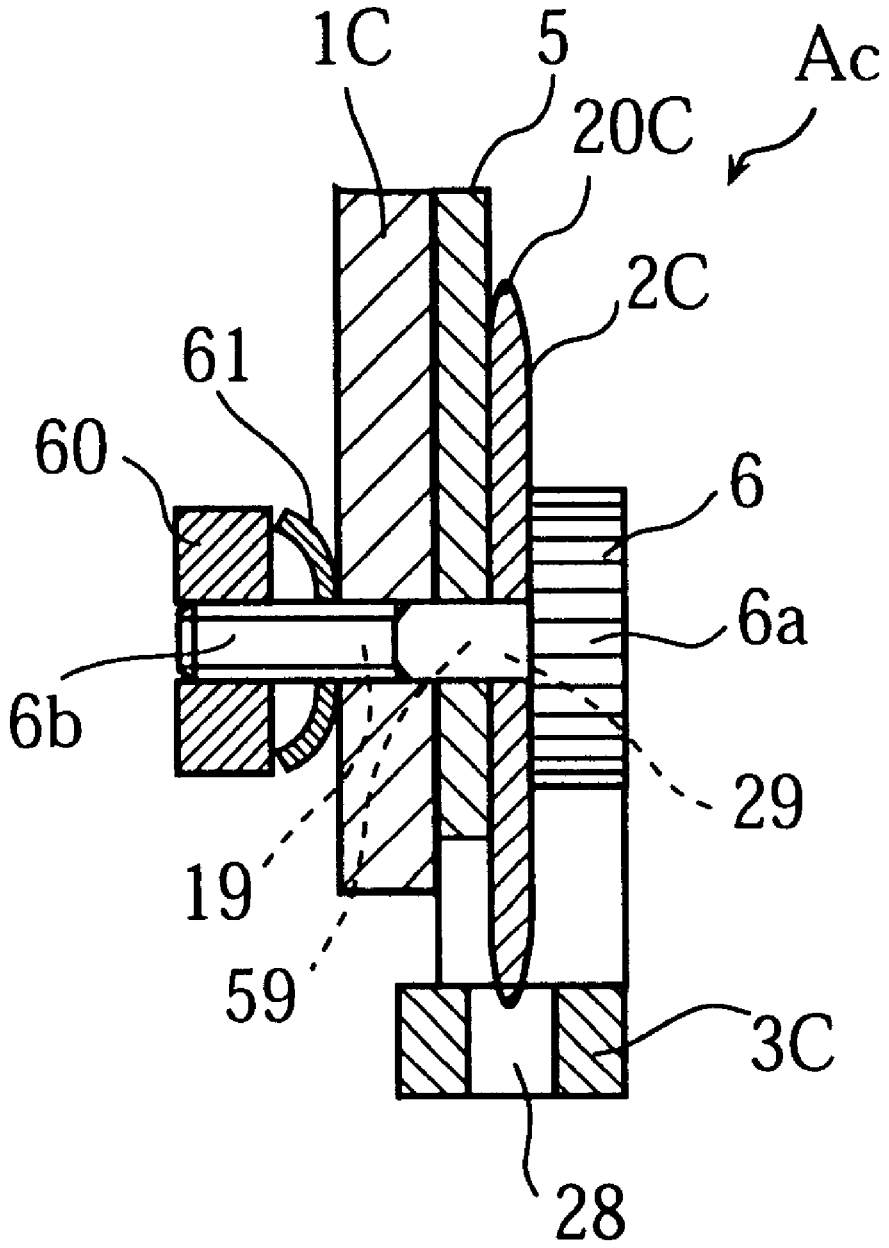
FIG. 10 is a sectional view taken along lines X—X in FIG. 8.

As can be seen from FIGS. 9 and 10, the handle 1C, the cutting member 2C and the attachment 5 are held together by way of a bolt 6 and a nut 60. For allowing passage of the shank 6*b* of the bolt 6, the handle 1C is formed with a through-hole 19, the cutting member 2C with a through-hole 29, and the attachment 5 with a through-hole 59.

Figure 11:
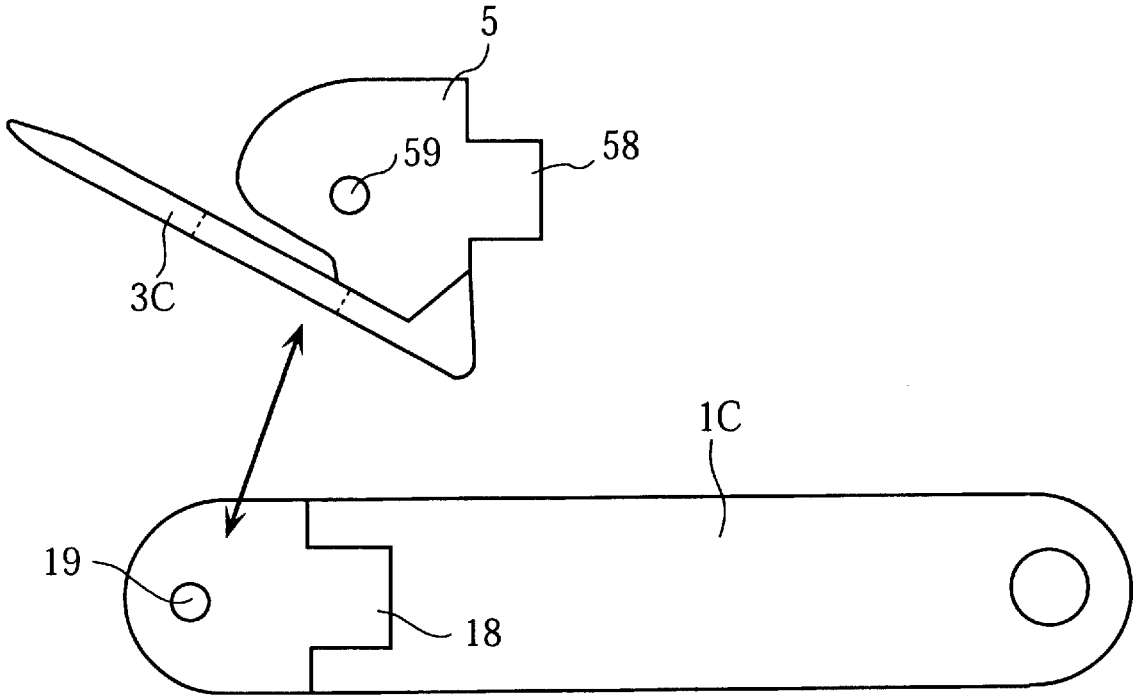
FIG. 11 is an exploded view showing elements of the cutter in FIG. 8.

As shown in FIG. 11, the attachment 5 is formed with a protrusion 58 extending in a generally opposite direction to the guiding member 3C, while the handle 1C is formed with a cutout 18 in a side surface of the handle. In this arrangement, when the cutter Ac is assembled, the protrusion 58 is fitted into the cutout 18, so that the attachment 5 is prevented from unduly rotating about the shank 6*b* of the bolt 6.

Referring to FIGS. 9 and 10, a washer 61 is provided between the nut 60 and the handle 1C for adjusting a pressing force acting on the cutting member 2C. By proper adjustment, it is possible to arrange that the cutting member 2C is suitably rotated about the shank 6*b* as the cutting of the upper cloth layers 7*b*–7*d* is performed. In this manner, it is possible to prevent the same part of the cutting member 2C from being used during the cutting operation.

Figure 8:
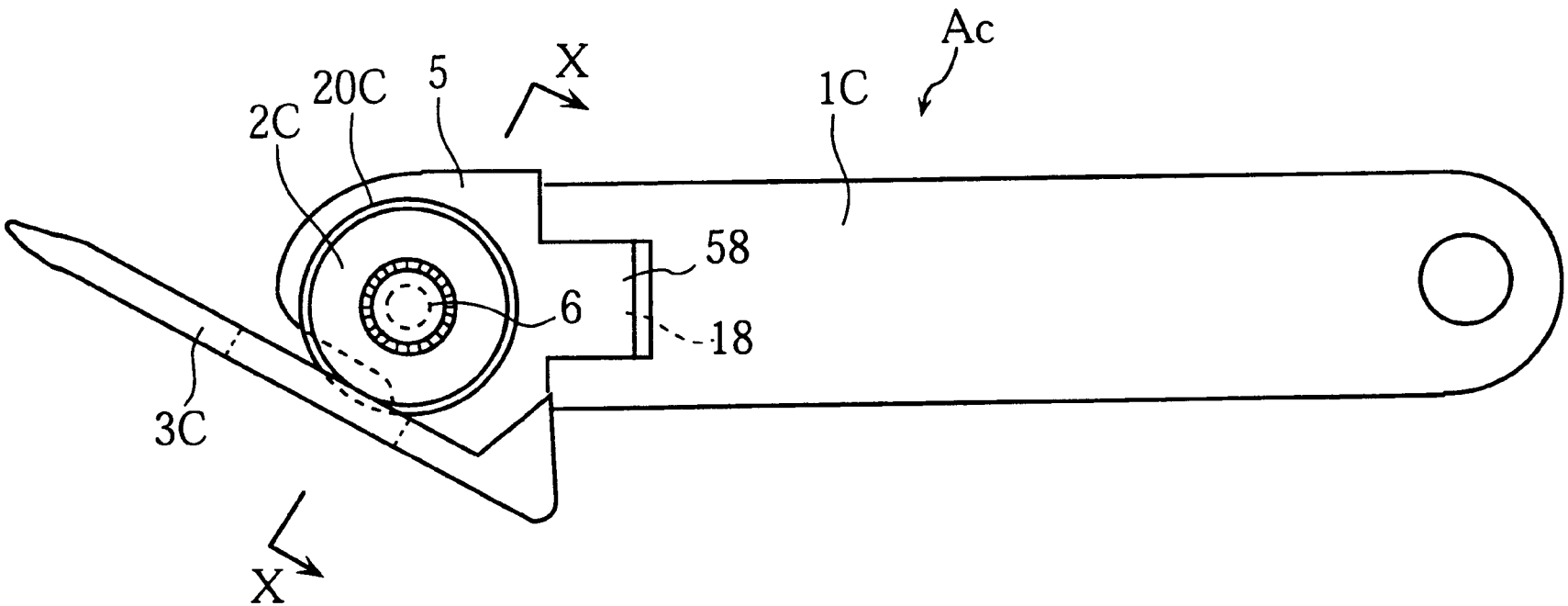
FIG. 8 is a side view showing a sewing cutter according to a fourth embodiment of the present invention.

As shown in FIG. 8, the circular cutting member 2C is diametrically smaller than the attachment 5, except that part of the cutting member 2C is arranged to project from the attachment 5 toward the guiding member 3C for cutting the upper cloth layers 7*b*–7*d*. Such an arrangement is advantageous in protecting the user from injury by the cutting edge 20C.

The guiding member 3C is arranged to extend at a predetermined angle with respect to the longitudinal direction of the handle 1C. The length of the guiding member 3C is greater than the diameter of the cutting member 2C. Thus, the guiding member 3C extends from the attachment 5 beyond the cutting point (the exposed portion) of the cutting member 2C. The guiding member 3C is formed with a retreated portion 28. Thus, the projected portion of the cutting member 2C is prevented from contacting the guiding member 3C. The illustrated retreated portion 28 is a through-hole, but this arrangement is not limitative. For instance, the retreated portion 28 of the guiding member 3C may be a groove which is open toward the cutting member 2C but closed on the opposite side.

Figure 12:
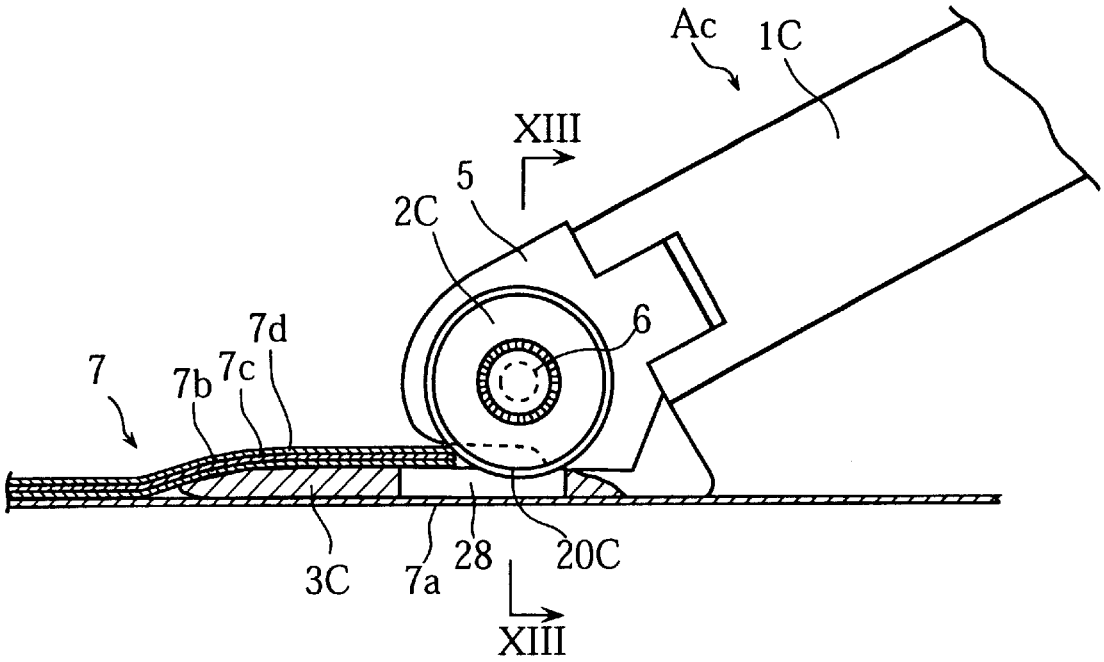
FIG. 12 is a side view showing the cutter in FIG. 8 in use.
Figure 13:
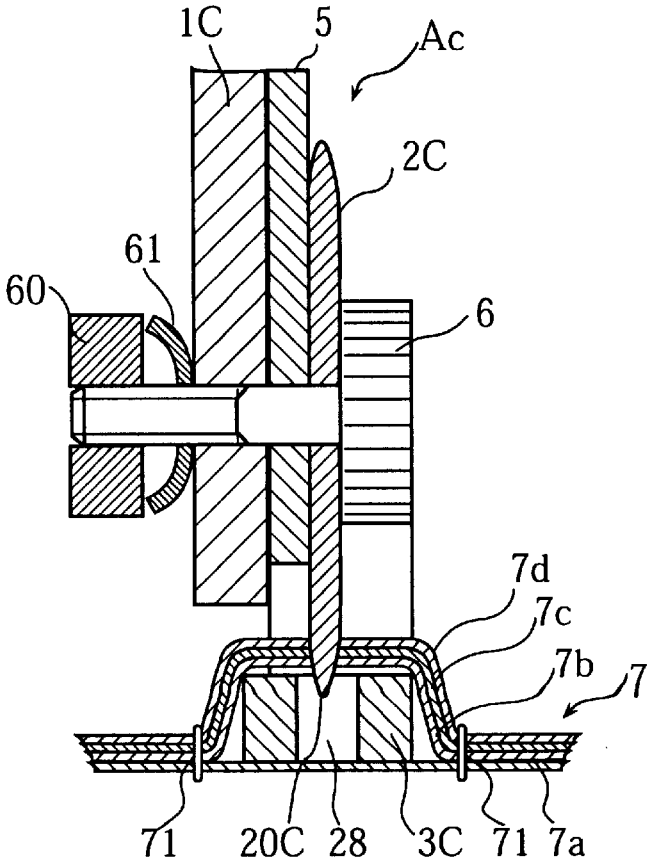
FIG. 13 is a sectional view taken along lines XIII—XIII in FIG. 12.

In use, the guiding member 3C is inserted into one of the elongated spaces of the quilt 7, as shown in FIGS. 12 and 13. In this embodiment again, the upper cloth layers 7*b*–7*d* to be cut by the cutter Ac are properly stretched sideways due to the presence of the guiding member 3C. Thus, the cutting operation by the cutter Ac is easily performed.

Figure 14:
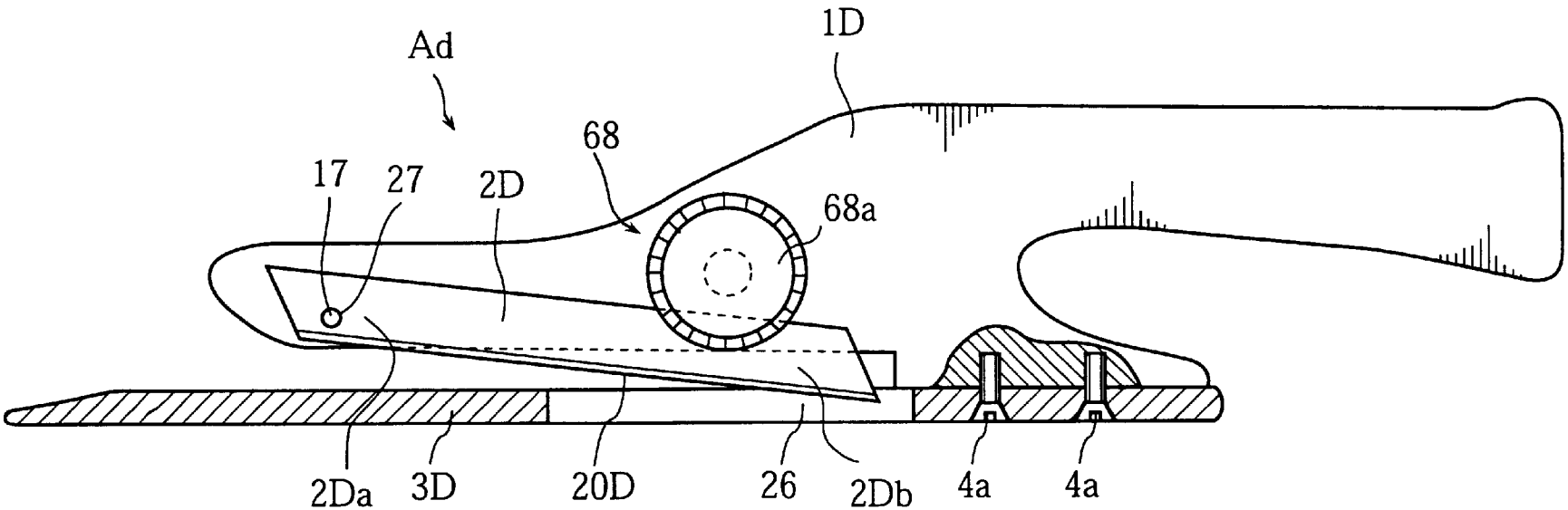
FIG. 14 is a side view, partly in section, showing a sewing cutter according to a fifth embodiment of the present invention.
Figure 15:
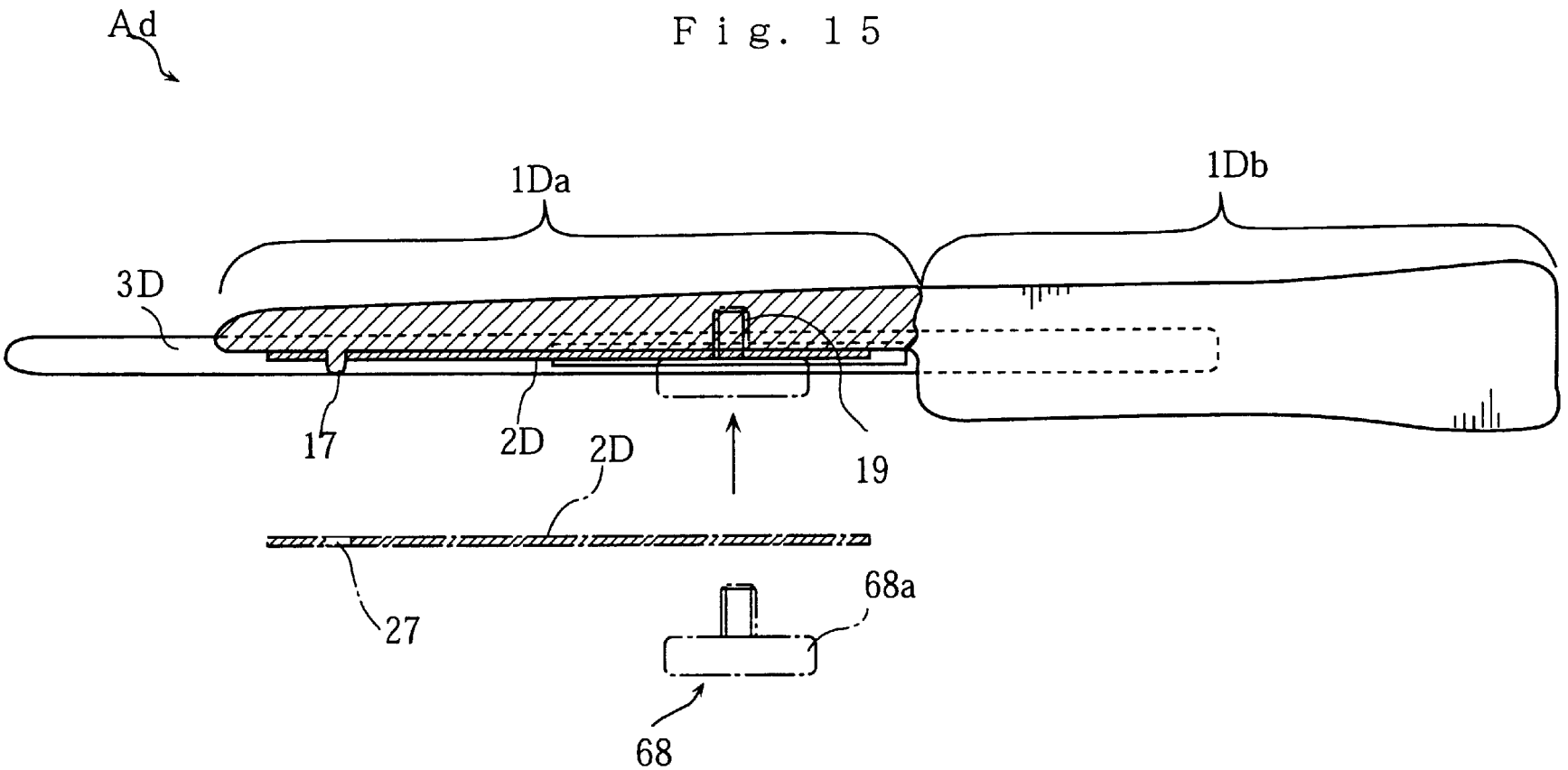
FIG. 15 is a plan view, partly in section, showing the cutter in FIG. 14.

FIGS. 14 and 15 show a sewing cutter 1D according to a fifth embodiment of the present invention. The sewing cutter 1D includes an handle 1D, an elongated cutting member 2D and a guiding member 3D.

As shown in FIG. 15, the handle 1D includes a front portion 1D*a* having a smaller thickness and a rear portion 1D*b* having a greater thickness. The front portion 1D*a* has an inner side surface (the surface facing downward in the FIG. 15) formed with a protrusion 17, and a threaded hole 19 which is spaced from the protrusion 17 by a predetermined distance. A bolt 68 is received in the hole 19 in engagement therewith.

The cutting member 2D has two end portions 2D*a* and 2D*b*. One of them (2D*a*) is formed with a through-hole 27 for allowing insertion of the protrusion 17. To fix the cutting member 2D to the handle 1D, first the protrusion 17 of the handle 1D is fitted into the through-hole 27. Then, by turning the bolt 68 for tightening, the other end portion 2D*b* is held between the head 68*a* of the bolt and the inner side surface of the handle 1D. In the fixed position, the front end portion 2D*a* is arranged to be farther from the guiding member 3D than the rear end portion 2D*b*, as shown in FIG. 14.

The guiding member 3D is releasably attached to a lower part of the handle 1D by screws 4*a* for example. The guiding member is formed with a through-hole 26 for preventing the contact with the cutting edge 20D of the cutting member 2D.

By using the cutter Ad according to the fifth embodiment in the same manner described above in connection with the previous embodiments, the quilt 7 (FIG. 3) is properly cut. In the fifth embodiment, the cutting member 2D is easily detached from the handle 1D by loosening the bolt 68.

The present invention being thus described, it is obvious that the same may be varied in many ways. Such variations should not be regarded as a departure from the spirit and scope of the present invention, and all such modifications as would be obvious to those skilled in the art are intended to be included within the scope of the following claims.

What is claimed is:

1. A sewing cutter for making a slash quilt comprising:

a handle;

a cutting member attached to the handle; and a guiding member supported by the handle;

wherein the guiding member has a surface brought into facing relation to cloth to be cut by the cutting member;

wherein the cutting member comprises a circular plate which is supported for rotation and formed with a cutting edge extending circumferentially of the circular plate; and wherein the guiding member is formed with a retreated portion in the form of a groove in which the cutting member partially enters without contacting the guide member;

wherein the circular plate has an opposite pair of side surfaces, the cutting edge being positioned between the pair of said faces.

2. The sewing cutter according to claim 1, wherein the guiding member comprises a plate which is elongated in a cutting direction.

3. The sewing cutter according to claim 1, wherein the guiding member is greater in width than the cutting member.

4. The sewing cutter according to claim 1, wherein the cutting member has a cutting point for said cloth, the guiding member being provided with a front portion arranged ahead of the cutting point in a cutting direction.

5. The sewing cutter according to claim 4, wherein the front portion of the guiding member is tapered.

6. The sewing cutter according to claim 1, wherein the cutting member is detachable from the handle.

7. The sewing cutter according to claim 1, wherein the guiding member is detachable from the handle.

8. The sewing cutter according to claim 1, wherein the handle is integrally formed with the guiding member.

9. The sewing cutter according to claim 1, wherein the cutting member is integrally formed with the guiding member.

10. The sewing cutter according to claim 1, further comprising an attachment which is separate from the handle and integrally formed with the guiding member.

* * * * *